US009947252B2

(12) United States Patent
Liu et al.

(10) Patent No.: US 9,947,252 B2
(45) Date of Patent: Apr. 17, 2018

(54) ARRAY SUBSTRATE AND DETECTING METHOD THEREFORE, DISPLAY PANEL, AND DISPLAY DEVICE FOR IMPROVED DETECTION RATE AND ACCURACY OF AN ARRAY TEST

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Chong Liu, Beijing (CN); Tielin Zhang, Beijing (CN); Haisheng Zhao, Beijing (CN); Zhilong Peng, Beijing (CN); Huanping Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 276 days.

(21) Appl. No.: 14/803,705

(22) Filed: Jul. 20, 2015

(65) Prior Publication Data

US 2016/0196773 A1 Jul. 7, 2016

(30) Foreign Application Priority Data

Jan. 4, 2015 (CN) ..... 2015 1 0001804

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2300/0426* (2013.01); *G09G 2330/12* (2013.01)

(58) Field of Classification Search
CPC ..... G09G 3/006; G09G 3/3648; G09G 2300/0426; G09G 2330/12
See application file for complete search history.

(56) References Cited

U.S. PATENT DOCUMENTS 9,406,251 B2 8/2016 Shao et al.
9,653,012 B2 5/2017 Liu et al.
(Continued)

FOREIGN PATENT DOCUMENTS

CN 1897094 A 1/2007
CN 101295720 A 10/2008
(Continued)

OTHER PUBLICATIONS

Second Office Action dated Mar. 6, 2017 in corresponding Chinese Application No. 201510001804.8.
(Continued)

*Primary Examiner* — Lisa Landis
(74) *Attorney, Agent, or Firm* — Nath, Goldberg & Meyer; Joshua B. Goldberg; Annie J. Kock

(57) ABSTRACT

The present invention provides an array substrate and a detecting method therefor, a display panel and a display device. The array substrate comprises a plurality of data lines, a plurality of short circuit rings respectively provided at ends of the plurality of data lines, and a common wire connecting the plurality of short circuit rings in series, wherein, a switch unit is provided between the end of each data line and the corresponding short circuit ring, and the switch unit is configured to disconnect the data line with the corresponding short circuit ring in a testing stage. The present invention can improve the detection rate and accuracy rate in an array test.

19 Claims, 1 Drawing Sheet

(56) References Cited

U.S. PATENT DOCUMENTS

| | | | | |
|---|---|---|---|---|
| 2015/0325158 | A1* | 11/2015 | Shao | G09G 3/006 324/750.3 |
| 2015/0325188 | A1 | 11/2015 | Wei et al. | |

FOREIGN PATENT DOCUMENTS

| | | | |
|---|---|---|---|
| CN | 103217844 | * | 7/2013 |
| CN | 103217844 | A | 7/2013 |
| CN | 103995407 | A | 8/2014 |
| CN | 104090437 | A | 10/2014 |
| JP | 8-179262 | A | 7/1996 |
| JP | H08179262 | A | 7/1996 |
| KR | 10-2014-0076660 | A | 6/2014 |
| KR | 20140076660 | A | 6/2014 |

OTHER PUBLICATIONS

First Office Action dated Oct. 26, 2016 corresponding to Chinese application No. 201510001804.8.

* cited by examiner

ARRAY SUBSTRATE AND DETECTING METHOD THEREFORE, DISPLAY PANEL, AND DISPLAY DEVICE FOR IMPROVED DETECTION RATE AND ACCURACY OF AN ARRAY TEST

FIELD OF THE INVENTION

The present invention relates to the field of display technology, and particularly relates to an array substrate and a detecting method therefor, a display panel comprising the array substrate and a display device comprising the display panel.

BACKGROUND OF THE INVENTION

In the field of manufacturing liquid crystal displays, after an array substrate is manufactured, an array test (AT) needs to be performed to detect whether a data line or a gate line in the array substrate is open, and the open data line or open gate line is repaired after a Data Open (DO) or Gate Open (GO) is detected. Therefore, during array test, the detection rate of DO and GO as well as the accuracy in detecting a defect position are vital to the post maintenance.

In an existing design of array substrate, as shown in FIG. 1, in general, one short circuit ring 20 is provided at an end (i.e., the end opposite to a source driving circuit) of each data line 10, all short circuit rings 20 are connected to the same common wire 30, and the short circuit ring 20 can conduct the instantaneous high voltage of static electricity existing in a display area out to the common wire 30, so as to dissipate the static electricity existing in the display area. However, since a plurality of short circuit rings 20 respectively provided at the ends of a plurality of data lines 10 are connected to the same common wire 30, when testing the plurality of data lines 10, a signal intrusion phenomenon may occur, thereby affecting the detection rate and accuracy of the array test.

The reason why a signal intrusion phenomenon occurs is as follows: since carriers can still pass through the channel of the thin film transistor in the short circuit ring 20 at a voltage of 0V, when testing the data lines 10, a high-level signal applied to the first data line 10 is conducted to the common wire 30 through the short circuit ring 20 provided at the end of the first data line 10, then flows onto a open data line 10 through the common wire 30 and the short circuit ring 20 provided at the end of the open data line 10, thus the signal intrusion phenomenon occurs to the open data line 10. This causes the open data line 10 that should not have a high-level signal to have a high-level signal, resulting in a failure to detect the disconnection of the data line 10, thereby affecting the detection rate and accuracy of the array test.

SUMMARY OF THE INVENTION

An object of the present invention is to provide an array substrate and a detecting method therefor, a display panel and a display device, in order to improve the detection rate and accuracy of an array test.

To achieve the above object, according to an aspect of the present invention, there is provided an array substrate, comprising a plurality of data lines, a plurality of short circuit rings respectively provided at ends of the plurality of data lines, and a common wire connecting the plurality of short circuit rings in series, wherein, a switch unit is provided between the end of each data line and the corresponding short circuit ring, and the switch unit is configured to disconnect the data line with the corresponding short circuit ring in a testing stage.

Preferably, the array substrate further comprises a switch control line, which is connected to all of the switch units, and is configured to control the switch units simultaneously.

Preferably, the switch unit comprises a first thin film transistor, a gate of which is connected to the switch control line, a first electrode of which is connected to the corresponding data line, and a second electrode of which is connected to the corresponding short circuit ring.

Preferably, the switch control line and the data lines are provided in different layers in a thickness direction of the array substrate, respectively.

Preferably, the array substrate further comprises a plurality of gate lines intersecting with the plurality of data lines, the gate lines and the data lines are provided in different layers in the thickness direction of the array substrate, respectively, and the switch control line and the gate lines are provided in the same layer.

Preferably, the common wire and the gate lines are provided in the same layer.

Preferably, the array substrate comprises a display area and a non-display area surrounding the display area, and the switch units, the short circuit rings and the common wire are provided in the non-display area.

Preferably, the short circuit ring comprises:

a second thin film transistor, a gate and a first electrode of which are connected to the corresponding data line, and a second electrode of which is connected to the common wire; and a third thin film transistor, a gate and a first electrode of which are connected to the common wire, and a second electrode of which is connected to the corresponding data line.

Correspondingly, the present invention further provides a detecting method for an array substrate, the array substrate is any one of the above array substrates provided by the present invention, and the detecting method comprises steps of:

cutting off each switch unit, so as to disconnect each data line with the corresponding short circuit ring; and inputting a testing signal to each data line.

Preferably, the array substrate further comprises a switch control line, which is connected to all of the switch units, and is configured to control the switch units simultaneously, and the step of cutting off each switch unit comprises: inputting an off signal to the switch control line.

After the step of inputting a testing signal to each data line, the detecting method further comprises a step of:

detecting a signal of each pixel unit of the array substrate by using a detector, and determining that the data line connected to a certain column of pixel units is open when the signals of the certain column of pixel units are not detected by the detector.

Correspondingly, the present invention further provides a display panel, comprising the above array substrate provided by the present invention.

Correspondingly, the present invention further provides a display device, comprising the above display panel provided by the present invention.

During an array test, each switch unit is cut off, so that each data line and the corresponding short circuit ring thereof are disconnected, and accordingly, any two or more data lines cannot be indirectly connected through the common wire and the corresponding short circuit rings. With such configuration, even though a certain data line has a defect (for example, the data line is disconnected due to an opening existing thereon), a high-level signal on another data line will not flow onto the data line with the defect through the common wire and the short circuit rings, thus, the position of the data line with the defect can be detected accurately, thereby improving the detection rate and accuracy rate. After the array test is finished and the data line with the defect is repaired, each switch unit is conducted, so that each data line is connected to the corresponding short circuit ring. Accordingly, when an instantaneous high-level signal is generated on a certain data line due to static electricity, the high-level signal can flow to the common wire through the corresponding short circuit ring, so that the high level on this data line is reduced and damage to the pixel unit by the high-level signal is avoided.

BRIEF DESCRIPTION OF THE DRAWINGS

Accompanying drawings, which constitute a part of the description, are used for providing further understanding of the present invention, and for explaining the present invention together with the following specific implementations, rather than limiting the present invention. In the accompanying drawings.

DETAILED DESCRIPTION OF THE EMBODIMENTS

The specific implementations of the present invention are described in detail below in conjunction with the accompanying drawings. It should be understood that, the specific implementations described herein are merely used for describing and explaining the present invention, rather than limiting the present invention.

Figure 1:
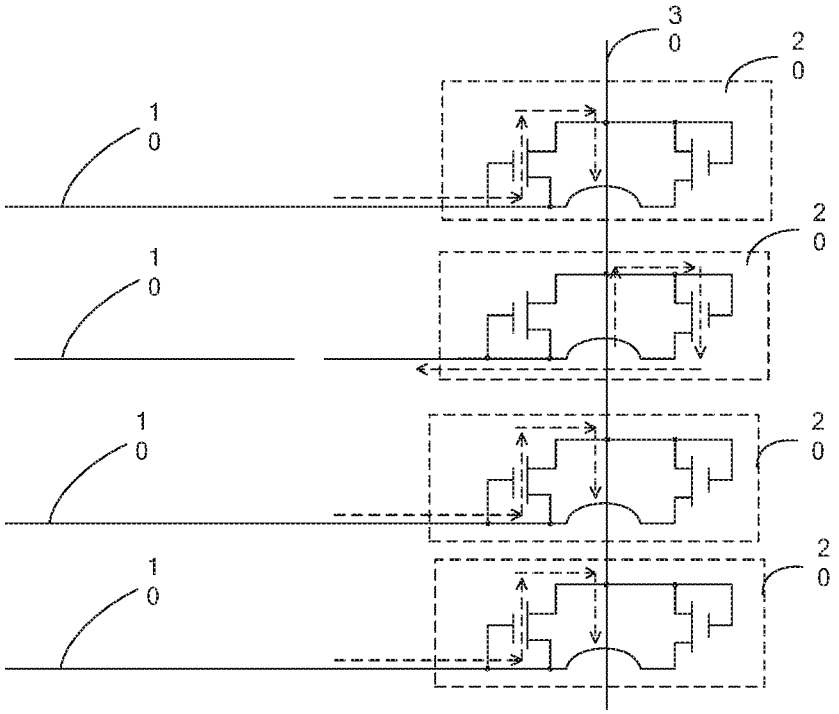
Fig. 1 PRIOR ART
FIG. 1 is a schematic diagram of structures of data lines and short circuit rings in an array substrate in the prior art.
Figure 2:
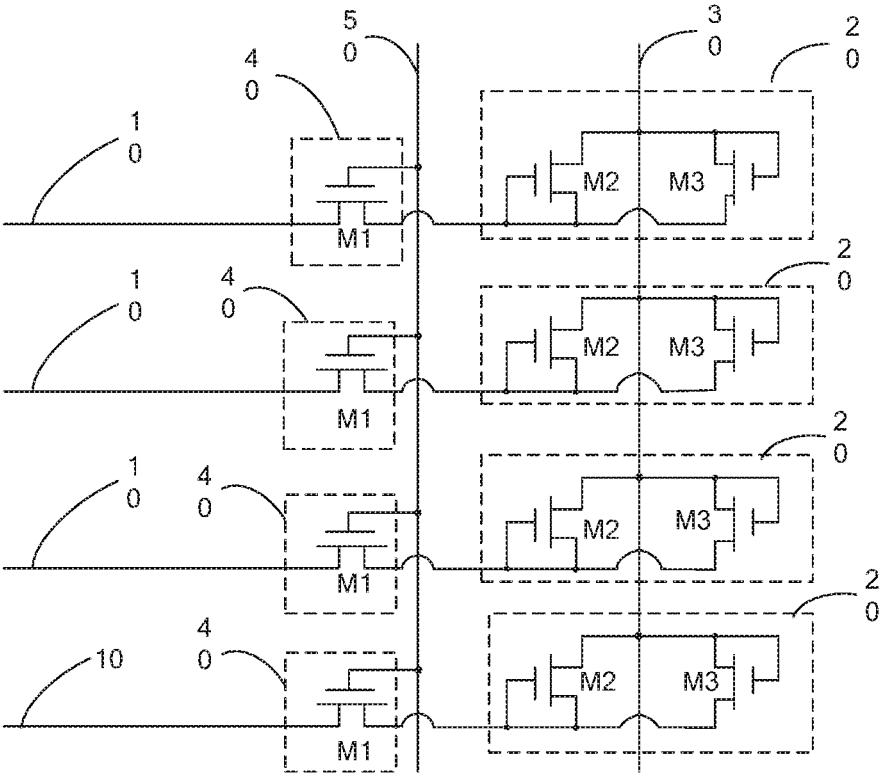
FIG. 2 is a schematic diagram of structures of data lines and short circuit rings in an array substrate provided by an embodiment of the present invention.

As a first aspect of the present invention, there is provided an array substrate, which, as shown in FIG. 2, comprises a plurality of data lines 10, a plurality of short circuit rings 20 respectively provided at ends of the plurality of data lines 10, and a common wire 30 connecting the plurality of short circuit rings 20 in series. A switch unit 40 is provided between the end of each data line 10 and the corresponding short circuit ring 20 (i.e., the short circuit ring 20 provided at the end of this data line 10), and the switch unit 40 is configured to disconnect the data line 10 (i.e., the data line 10 whose end is connected to this switch unit 40) with the corresponding short circuit ring 20 in a testing stage. It can be understood that, a source driving circuit for providing driving signals to the data lines 10 is provided on the array substrate, and "end of the data line" refers to the end of the data line opposite to the source driving circuit.

During an array test, each switch unit 40 is cut off, so that each data line and the corresponding short circuit ring thereof are disconnected, and accordingly, any two or more data lines cannot be indirectly connected through the common wire and the corresponding short circuit rings. With such configuration, even though a certain data line 10 has a defect (for example, the data line is disconnected due to an opening existing thereon), a high-level signal on another data line 10 will not flow onto the data line with the defect through the common wire and the short circuit rings, thus, the position of the data line with the defect can be detected accurately, thereby improving the detection rate and accuracy rate. After the array test is finished and the data line with the defect is repaired, each switch unit 40 is conducted, so that each data line is connected to the corresponding short circuit ring. Accordingly, when an instantaneous high-level signal is generated on a certain data line 10 due to static electricity, the high-level signal can flow into the common wire 30 through the corresponding short circuit ring, so that the high level on this data line 10 is reduced and damage to the pixel unit by the high-level signal is avoided.

During an array test, a testing signal is applied to each data line 10, and the signal of each pixel unit is detected by a detector. In the present invention, the signal intrusion phenomenon can be avoided due to the switch units 40. Therefore, when a certain data line 10 has a defect, signals of one column of pixel units corresponding to the data line 10 cannot be detected, and it can be determined that the data line corresponding to the column of pixel units has a defect.

The structure of the switch unit 40 is not specifically limited in the present invention, as long as it can disconnect the corresponding data line 10 with the corresponding short circuit ring 20 during test. As a specific implementation of the present invention, as shown in FIG. 2, the array substrate further comprises a switch control line 50 connected to all of the switch units 40, and the switch control line 50 is configured to control all of the switch units 40 simultaneously. Specifically, the switch unit 40 may comprises a first thin film transistor M1, a gate of which is connected to the switch control line 50, a first electrode of which is connected to the corresponding data line 10, and a second electrode of which is connected to the corresponding short circuit ring 20.

When an on signal is applied to the switch control line 50, each first thin film transistor M1 is turned on, and each data line 10 is connected to the corresponding short circuit ring 20. When an instantaneous high-level signal exists on a certain data line 10, the high-level signal can flow into the common wire 30 through the corresponding short circuit ring 20, so as to reduce the high level on this data line 10 and avoid damage to the pixel unit by the high-level signal. When an off signal is applied to the switch control line 50, each first thin film transistor M1 is turned off, each data line 10 is disconnected with the corresponding short circuit ring 20, and thus the signal intrusion phenomenon is avoided from happening to the data line 10. The setting of the switch control line 50 helps to control all of the first thin film transistor M1 at the same time, so as to connect or disconnect each data line 10 with the corresponding short circuit ring 20 simultaneously.

It can be understood that, the array substrate further comprises a signal generating module, which is configured to generate a control signal (i.e., on signal or off signal) for the first thin film transistors M1, and the control signal is transferred to the gates of the first thin film transistors M1 through the switch control line 50, so as to control on/off of each first thin film transistor M1. The first thin film transistor M1 may be a N-type or P-type thin film transistor. When the first thin film transistor M1 is a N-type thin film transistor, the on signal is a high-level signal, and the off signal is a low-level signal; when the first thin film transistor M1 is a P-type thin film transistor, the on signal is a low-level signal, and the off signal is a high-level signal.

In order that the switch control line 50 can control the first thin film transistors M1 simultaneously and does not contact with the data lines 10, the switch control line 50 and the data lines 10 may be provided in different layers in the thickness direction of the array substrate, respectively. Specifically, the array substrate may comprises a plurality of gate lines intersecting with the plurality of data lines, the gate lines and the data lines 10 are provided in different layers in the thickness direction of the array substrate, respectively, the switch control line 50 may be provided in the same layer as the gate lines, and therefore, the switch control line 50 and the gate lines can be formed simultaneously by using the same material in the manufacture. In this way, based on the existing manufacturing process of an array substrate, no additional process is required by simultaneously forming the switch control line 50 and the gate lines, thereby saving the process cost and improving the production efficiency.

Like the switch control line 50, the common wire 30 may also be provided in the same layer as the gate lines, and the common wire 30 and the gate lines can be formed simultaneously by using the same material in the manufacture.

Further, the array substrate comprises a display area and a non-display area surrounding the display area, and the switch units 40, the short circuit rings 20 and the common wire 30 are provided in the non-display area, so as not to block the display area.

Further, the short circuit ring 20 may have various structures, which is not limited in the present invention, as long as it can effectively conduct the instantaneous high voltage of static electricity existing in the display area out to the common wire 30. As a specific implementation, as shown in FIG. 2, the short circuit ring 20 comprises a second thin film transistor M2 and a third thin film transistor M3. Both a gate and a first electrode of the second thin film transistor M2 are connected to the corresponding data line 10, and a second electrode of the second thin film transistor M2 is connected to the common wire 30. Both a gate and a first electrode of the third thin film transistor M3 are connected to the common wire 30, and a second electrode of the third thin film transistor M3 is connected to the corresponding data line 10. The second thin film transistor M2 and the third thin film transistor M3 may be the thin film transistors of the same type, for example, both the second thin film transistor M2 and the third thin film transistor M3 may be N-type thin film transistors.

After the array substrate is manufactured and the data line with a defect is repaired, each switch unit 40 is conducted, in this case, when an instantaneous high-level signal is generated on a certain data line 10 due to static electricity, the second thin film transistor M2 in the short circuit ring 20 corresponding to the data line 10 is turned on, so that the high-level signal flows to the common wire 30 through the second thin film transistor M2, and the third thin film transistor M3 in each short circuit ring 20 is turned on. At this point, the high-level signal on the data line 10 can be dispersed through the common wire 30 and the short circuit rings 20 connected to the common wire 30, so as to avoid damage to pixel units by a too high instantaneous voltage on the certain data line 10. The common wire 30 may be connected to a low-level signal port on the array substrate, so as to lower a high level.

It can be understood that, thin film transistors for pixel units are provided in the display area of the array substrate. Therefore, in manufacturing an array substrate, the thin film transistors for pixel units, the first thin film transistors M1, the second thin film transistors M2 and the third thin film transistors M3 may be formed simultaneously. Specifically, at first, gates of the four types of thin film transistors (i.e., the thin film transistors for pixel units, the first thin film transistors M1, the second thin film transistors M2 and the third thin film transistors M3) are formed simultaneously by using the same material, then, insulating layers of the four types of thin film transistors are formed simultaneously by using the same material, subsequently, active layers, drains, sources and the like of the four types of thin film transistors are formed simultaneously by using the same material. In addition, the gate lines, the common wire 30, the switch control line 50 and the gates of the four types of thin film transistors may be formed simultaneously, thereby simplifying the manufacturing process of an array substrate and lowering the manufacturing cost.

Of course, in specific implementation, the short circuit ring 20 may have other structure, which is not elaborated herein.

As a second aspect of the present invention, there is provided a detecting method for an array substrate, the array substrate is the above array substrates provided by the present invention, and the detecting method comprises steps of:

cutting off each switch unit, so as to disconnect each data line with the corresponding short circuit ring; and inputting a testing signal to each data line.

In detecting, that is, after inputting the testing signal to each data line, the signal of each pixel unit is detected by using a detector, if the detector cannot detect the signals of a certain column of pixel units, it is then determined that the data line corresponding to this column of pixel units is disconnected, and thus the position of the disconnected data line is determined according to signal abnormity of the pixel units.

As described above, the array substrate further comprises a switch control line, which is connected to all of the switch units and is configured to control the switch units simultaneously. The switch unit may comprises a first thin film transistor, a gate of which is connected to the switch control line, a first electrode of which is connected to the corresponding data line, and a second electrode of which is connected to the corresponding short circuit ring.

The step of cutting off each switch unit may specifically comprise: inputting an off signal to the switch control line, so that each data line is disconnected with the corresponding short circuit ring. Then, a testing signal is input to each data line. Since each data line is disconnected with the corresponding short circuit ring, the signal intrusion phenomenon can be avoided, and if there is a data line with a defect, it is impossible to detect a high-level signal on the data line with a defect, i.e., the position of the data line with a defect can be determined accurately, thereby improving the detection rate and accuracy rate.

In the array substrate and the detecting method therefor provided by the present invention, the switch unit is provided between each data line and the corresponding short circuit ring, during an array test, and a testing signal is input to each data line after each switch unit is cut off. Since each data line and the corresponding short circuit ring are disconnected, the signal intrusion phenomenon can be avoided, and the position of the data line with a defect can be determined accurately, thereby improving the detection rate and accuracy rate of an array test. After the array test is finished, each switch unit is conducted, and each data line is connected to the corresponding short circuit ring, so as to avoid influence of a high-level signal generated on a certain data line 10 due to static electricity on the pixel units, thereby improving the quality of the products.

As a third aspect of the present invention, there is provided a display panel, which comprises the above array substrate.

As a fourth aspect of the present invention, there is provided a display device, which comprises the above display panel.

Since the detection rate and accuracy rate of an array test for an array substrate are improved, the quality of the finished products of array substrates is improved, and thus the qualities of the display panel and the display device are improved.

It should be understood that the above implementations are only exemplary implementations for illustrating the principle of the present invention; however, the present invention is not limited thereto. Various variations and improvements can be made by a person skill in the art without departing from the spirit and essence of the present invention, and these variations and improvements should also be considered to be within the protection scope of the present invention.

The invention claimed is:

1. An array substrate, comprising:

a plurality of data lines;

a source driving circuit for providing driving signals to the plurality of data lines;

a plurality of short circuit rings, which are provided at ends of the plurality of data lines opposite to the source driving circuit, respectively; and a common wire, which connects the plurality of short circuit rings in series, wherein, a switch unit is provided between the end of each data line opposite to the source driving circuit and the corresponding short circuit ring, and the switch unit is configured to disconnect the data line with the corresponding short circuit ring in a testing stage.

2. The array substrate according to claim 1, wherein, the array substrate further comprises a switch control line, which is connected to all of the switch units, and is configured to control the switch units simultaneously.

3. The array substrate according to claim 2, wherein, the switch unit comprises a first thin film transistor, a gate of which is connected to the switch control line, a first electrode of which is connected to the corresponding data line, and a second electrode of which is connected to the corresponding short circuit ring.

4. The array substrate according to claim 2, wherein, the switch control line and the data lines are provided in different layers in a thickness direction of the array substrate, respectively.

5. The array substrate according to claim 4, wherein, the array substrate further comprises a plurality of gate lines intersecting with the plurality of data lines, the gate lines and the data lines are provided in different layers in the thickness direction of the array substrate, respectively, and the switch control line and the gate lines are provided in the same layer.

6. The array substrate according to claim 5, wherein, the common wire and the gate lines are provided in the same layer.

7. The array substrate according to claim 1, wherein, the array substrate comprises a display area and a non-display area surrounding the display area, and the switch units, the short circuit rings and the common wire are provided in the non-display area.

8. The array substrate according to claim 1, wherein, the short circuit ring comprises:

a second thin film transistor, a gate and a first electrode of which are connected to the corresponding data line, and a second electrode of which is connected to the common wire; and a third thin film transistor, a gate and a first electrode of which are connected to the common wire, and a second electrode of which is connected to the corresponding data line.

9. A detecting method for an array substrate, the array substrate comprising:

a plurality of data lines;

a source driving circuit for providing driving signals to the plurality of data lines;

a plurality of short circuit rings, which are provided at ends of the plurality of data lines opposite to the source driving circuit respectively; and a common wire, which connects the plurality of short circuit rings in series, wherein, a switch unit is provided between the end of each data line opposite to the source driving circuit and the corresponding short circuit ring, and the switch unit is configured to disconnect the data line with the corresponding short circuit ring in a testing stage, and the detecting method comprises steps of:

cutting off each switch unit, so as to disconnect each data line with the corresponding short circuit ring; and inputting a testing signal to each data line.

10. The detecting method according to claim 9, wherein, the array substrate further comprises a switch control line, which is connected to all of the switch units, and is configured to control the switch units simultaneously, and the step of cutting off each switch unit comprises: inputting an off signal to the switch control line.

11. The detecting method according to claim 9, wherein, after the step of inputting a testing signal to each data line, the detecting method further comprises a step of:

detecting a signal of each pixel unit of the array substrate by using a detector, and determining that the data line connected to a certain column of pixel units is open when the signals of the certain column of pixel units are not detected by the detector.

12. A display device, comprising a display panel, which comprises an array substrate, wherein the array substrate comprises:

a plurality of data lines;

a source driving circuit for providing driving signals to the plurality of data lines;

a plurality of short circuit rings, which are provided at ends of the plurality of data lines opposite to the source driving circuit, respectively; and a common wire, which connects the plurality of short circuit rings in series, wherein, a switch unit is provided between the end of each data line opposite to the source driving circuit and the corresponding short circuit ring, and the switch unit is configured to disconnect the data line with the corresponding short circuit ring in a testing stage.

13. The display device according to claim 12, wherein, the array substrate further comprises a switch control line, which is connected to all of the switch units, and is configured to control the switch units simultaneously.

14. The display device according to claim 13, wherein, the switch unit comprises a first thin film transistor, a gate of which is connected to the switch control line, a first electrode of which is connected to the corresponding data line, and a second electrode of which is connected to the corresponding short circuit ring.

15. The display device according to claim 13, wherein, the switch control line and the data lines are provided in different layers in a thickness direction of the array substrate, respectively.

16. The display device according to claim 15, wherein, the array substrate further comprises a plurality of gate lines intersecting with the plurality of data lines, the gate lines and the data lines are provided in different layers in the thickness direction of the array substrate, respectively, and the switch control line and the gate lines are provided in the same layer.

17. The display device according to claim 16, wherein, the common wire and the gate lines are provided in the same layer.

18. The display device according to claim 12, wherein, the array substrate comprises a display area and a non-display area surrounding the display area, and the switch units, the short circuit rings and the common wire are provided in the non-display area.

19. The display device according to claim 12, wherein, the short circuit ring comprises:

a second thin film transistor, a gate and a first electrode of which are connected to the corresponding data line, and a second electrode of which is connected to the common wire; and a third thin film transistor, a gate and a first electrode of which are connected to the common wire, and a second electrode of which is connected to the corresponding data line.

* * * * *